US008028517B2

(12) United States Patent
Demura

(10) Patent No.: US 8,028,517 B2
(45) Date of Patent: Oct. 4, 2011

(54) EXHAUST GAS PURIFICATION DEVICE FOR AN ENGINE

(75) Inventor: Takayuki Demura, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 1112 days.

(21) Appl. No.: 11/814,091

(22) PCT Filed: May 9, 2006

(86) PCT No.: PCT/JP2006/309620

§ 371 (c)(1),
(2), (4) Date: Jul. 17, 2007

(87) PCT Pub. No.: WO2006/123595

PCT Pub. Date: Nov. 23, 2006

(65) Prior Publication Data

US 2009/0013672 A1 Jan. 15, 2009

(30) Foreign Application Priority Data

May 20, 2005 (JP) ..... 2005-148222

(51) Int. Cl.
*F01N 3/00* (2006.01)

(52) U.S. Cl. ..... 60/295; 60/285; 60/301; 60/284; 60/274

(58) Field of Classification Search ..... 60/273, 60/274, 284–289, 295, 299, 300, 301
See application file for complete search history.

(56) References Cited

U.S. PATENT DOCUMENTS

| | | | | |
|---|---|---|---|---|
| 5,613,481 | A * | 3/1997 | Kitagawa et al. | 123/698 |
| 6,438,945 | B1 * | 8/2002 | Takagi et al. | 60/283 |
| 2004/0182374 | A1 | 9/2004 | Surnilla | |

FOREIGN PATENT DOCUMENTS

| | | |
|---|---|---|
| EP | 1 106 815 | 6/2001 |
| EP | 1 515 016 | 3/2005 |
| JP | 11 343836 | 12/1999 |
| JP | 11-343836 | 12/1999 |
| JP | 2000 18025 | 1/2000 |
| JP | 2000-230450 | 8/2000 |
| JP | 2003-65165 | 3/2003 |
| JP | 2004 68690 | 3/2004 |

* cited by examiner

*Primary Examiner* — Thomas Denion
*Assistant Examiner* — Jesse Bogue
(74) *Attorney, Agent, or Firm* — Oblon, Spivak, McClelland, Maier & Neustadt, L.L.P.

(57) ABSTRACT

According to the invention, an exhaust gas purification device for an engine is provided. The device comprises: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe. When a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio and a purge gas including fuel vapor is purged into an intake pipe, one of the amount of purge gas and the ratio of the amount of purge gas relative to an amount of fresh air flowing through the intake pipe is controlled on the basis of the concentration of fuel vapor in the purge gas.

8 Claims, 6 Drawing Sheets

EXHAUST GAS PURIFICATION DEVICE FOR AN ENGINE

BACKGROUND OF THE INVENTION

1. Field of the Invention

The invention relates to an exhaust gas purification device for an engine.

2. Description of the Related Art

As a catalyst for reducing and purifying nitrogen oxides (NOx) included in an exhaust gas discharged from the engine, a catalyst is known which absorbs or stores the NOx included in the exhaust gas to carry it therein when the air-fuel ratio of the exhaust gas flowing thereinto is larger (leaner) than the stoichiometric air-fuel ratio, and reduces and purifies the NOx carried therein when the air-fuel ratio of the exhaust gas flowing thereinto becomes a stoichiometric air-fuel ratio or smaller than the stoichiometric air-fuel ratio. An engine provided with the above-mentioned catalyst (hereinafter referred to as—NOx catalyst—) is disclosed in Unexamined Japanese Patent Publication No. 2004-68690.

The engine disclosed in the Publication No. 2004-68690 comprises six cylinders, which is divided into two cylinder groups. Each cylinder group is connected to an exhaust branch pipe. Further, the exhaust branch pipes are connected to a common exhaust pipe at their downstream ends. A NOx catalyst is positioned in the common exhaust pipe.

The exhaust gas also includes sulfur oxides (SOx) in addition to NOx. Therefore, the NOx catalyst can also carry SOx in addition to the NOx. When the NOx catalyst carries SOx, i.e. is contaminated by the sulfate, the capacity of the NOx catalyst to carry NOx is decreased. Therefore, in order to maintain the high capacity of the NOx catalyst to carry NOx, SOx should be removed from the NOx catalyst. In this connection, SOx can be removed from the NOx catalyst, i.e. the contamination of the NOx catalyst by the sulfate is regenerated, when the temperature of the NOx catalyst is increased to a temperature at which SOx can be removed from the NOx catalyst and the exhaust gas having the stoichiometric or rich (in particular, slightly rich) air-fuel ratio is supplied to the NOx catalyst.

According to the engine disclosed in the Publication No. 2004-68690, in order to remove SOx from the NOx catalyst, a following process for regenerating the sulfate contamination of the NOx catalyst is performed. That is, the air-fuel ratio of the exhaust gas discharged from one of the cylinder groups is controlled to a rich air-fuel ratio, while the air-fuel ratio of the exhaust gas discharged from other cylinder groups is controlled to a lean air-fuel ratio. Then, the exhaust gas having a rich air-fuel ratio (hereinafter referred to as—rich exhaust gas—) and the exhaust gas having a lean air-fuel ratio (hereinafter referred to as—lean exhaust gas—) are mixed with each other and flow into the NOx catalyst. In this case, a rich degree of the rich exhaust gas and a lean degree of the lean exhaust gas are controlled such that the air-fuel ratio of the exhaust gas resulting from the mixture of the rich exhaust gas and the lean exhaust gas becomes the stoichiometric air-fuel ratio.

In this case, the air-fuel ratio of the exhaust gas flowing into the NOx catalyst is controlled to the stoichiometric air-fuel ratio. In addition, when the rich exhaust gas and the lean exhaust gas are mixed with each other, the hydrocarbon (HC) included in the rich exhaust gas reacts with the oxygen included in the lean exhaust gas. Therefore, the heat produced by the reaction of the HC and the oxygen increases the temperature of the exhaust gas and thus the temperature of the NOx catalyst. Thereby, the temperature of the NOx catalyst is increased to the temperature at which the SOx can be removed from the NOx catalyst and the exhaust gas having a stoichiometric air-fuel ratio is supplied to the NOx catalyst. As a result, SOx is removed from the NOx catalyst.

An engine is known which comprises a charcoal canister for adsorbing and storing fuel vapor produced in an fuel tank. In this engine, in order to prevent that an activated charcoal of the canister is filled with the fuel vapor, when the engine is operated, the fuel vapor is discharged into an intake pipe from the canister.

The fuel vapor discharged into the intake pipe is introduced into the cylinders. In the engine disclosed in the Publication No. 2004-68690, if the fuel vapor is discharged from the canister into the intake pipe when the sulfate contamination regeneration process is performed, the amount of the fuel supplied into each cylinder is increased by the amount of the discharged fuel vapor. In this case, in particular, the amount of the fuel in the cylinder, from which the rich exhaust gas is discharged when the sulfate contamination regeneration process is performed, becomes excessively large. Therefore, the fuel may not burn in the cylinder.

The object of the invention is to ensure that the fuel burns in the cylinder in which the mixture gas is smaller (richer) than the stoichiometric air-fuel ratio when the process for regenerating the sulfate contamination of the NOx catalyst is performed.

SUMMARY OF THE INVENTION

According to the first aspect of the invention, there is provided an exhaust gas purification device for an engine, comprising: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe; wherein when a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio and a purge gas including fuel vapor is purged into an intake pipe, one of the amount of purge gas and the ratio of the amount of purge gas relative to an amount of fresh air flowing through the intake pipe is controlled on the basis of the concentration of fuel vapor in the purge gas.

According to the second aspect of the invention, in the first aspect, when the sulfate contamination regeneration process is performed, the purge gas including fuel vapor is purged into the intake pipe and the concentration of fuel vapor in the purge gas is larger than a predetermined concentration, one of the amount of purge gas and the ratio of the amount of purge gas relative to the amount of fresh air flowing through the intake pipe is decreased.

According to the third aspect of the invention, in the first aspect, when the sulfate contamination regeneration process is performed and the purge gas including fuel vapor is purged into the intake pipe, one of the amount of purge gas and the ratio of the amount of purge gas relative to the amount of fresh air flowing through the intake pipe is decreased substantially in inverse proportion to the concentration of fuel vapor in the purge gas.

According to the fourth aspect of the invention, there is provided, an exhaust gas purification device for an engine, comprising: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe; wherein when a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio, a purge gas including fuel vapor is purged into an intake pipe and a rich degree of the mixture gas in the cylinder from which the exhaust gas having a rich air-fuel ratio is discharged, is larger than a predetermined degree, one of the amount of purge gas and the ratio of the amount of purge gas relative to the amount of fresh air flowing through the intake pipe is decreased.

According to the fifth aspect of the invention, in the fourth aspect, when the sulfate contamination regeneration process is performed, the purge gas including fuel vapor is purged into the intake pipe and the concentration of fuel vapor in the purge gas is larger than a predetermined concentration, one of the amount of purge gas and the ratio of the amount of purge gas relative to the amount of fresh air flowing through the intake pipe is decreased.

According to the sixth aspect of the invention, there is provided an exhaust gas purification device for an engine, comprising: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe; wherein when a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio and a purge gas including fuel vapor is purged into an intake pipe, one of the amount purge gas and the ratio of the amount of purge gas relative to the amount of fresh air flowing through the intake pipe is decreased substantially in inverse proportion to a rich degree of the mixture gas in the cylinder from which the exhaust gas having a rich air-fuel ratio is discharged.

According to the seventh aspect of the invention, in the sixth aspect, when the sulfate contamination regeneration process is performed and the purge gas including fuel vapor is purged into the intake pipe, one of the amount of purge gas and the ratio of the amount of purge gas relative to the amount of fresh air flowing through the intake pipe is decreased substantially in inverse proportion to a concentration of fuel vapor in the purge gas.

According to the eighth aspect of the invention, there is provided an exhaust gas purification device for an engine, comprising: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe; wherein when a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio and a purge gas including fuel vapor is purged into an intake pipe, the air-fuel ratio of the mixture gas in each cylinder is controlled on the basis of a concentration of fuel vapor in the purge gas.

According to the ninth aspect of the invention, in the eighth aspect, when the sulfate contamination regeneration process is performed, the purge gas including fuel vapor is purged into the intake pipe and the concentration of fuel vapor in the purge gas is larger than a predetermined concentration, a rich degree of the mixture gas in the cylinder from which the exhaust gas having a rich air-fuel ratio is discharged, is decreased, while a lean degree of the mixture gas in the cylinder from which the exhaust gas having a lean air-fuel ratio is discharged, is increased.

According to the tenth aspect of the invention, in the eighth aspect, when the sulfate contamination regeneration process is performed and the purge gas including fuel vapor is purged into the intake pipe, the rich degree of the mixture gas in the cylinder from which the exhaust gas having a rich air-fuel ratio is discharged, is decreased substantially in inverse proportion to the concentration of fuel vapor in the purge gas, while the lean degree of the mixture gas in the cylinder from which the exhaust gas having a lean air-fuel ratio is discharged, is increased substantially in proportion to the concentration of fuel vapor in the purge gas.

According to the eleventh aspect of the invention, there is provided an exhaust gas purification device for an engine, comprising: a plurality of cylinders, the cylinders being divided into at least two cylinder groups; exhaust branch pipes connected to the cylinder groups at their upstream ends, respectively; a common exhaust pipe connected to the downstream ends of the exhaust branch pipes; and a NOx catalyst positioned in the common exhaust pipe; wherein when a sulfate contamination regeneration process for regenerating the sulfate contamination of the NOx catalyst is performed by controlling the air-fuel ratio of the exhaust gas discharged from one of the cylinder groups to a rich air-fuel ratio and controlling the air-fuel ratio of the exhaust gas discharged from the other cylinder group to a lean air-fuel ratio, a purge gas including fuel vapor is purged into an intake pipe and the concentration of fuel vapor in the purge gas is larger than a predetermined concentration, the sulfate contamination regeneration process is not performed.

According to the twelfth aspect of the invention, in the eleventh aspect, when the sulfate contamination regeneration process is performed, the purge gas including fuel vapor is purged into the intake pipe and the concentration of fuel vapor in the purge gas is larger than the predetermined concentration, the sulfate contamination regeneration process is not performed, while one of the amount of purge gas and the ratio of amount of purge gas relative to the amount of fresh air flowing through the intake pipe is increased.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
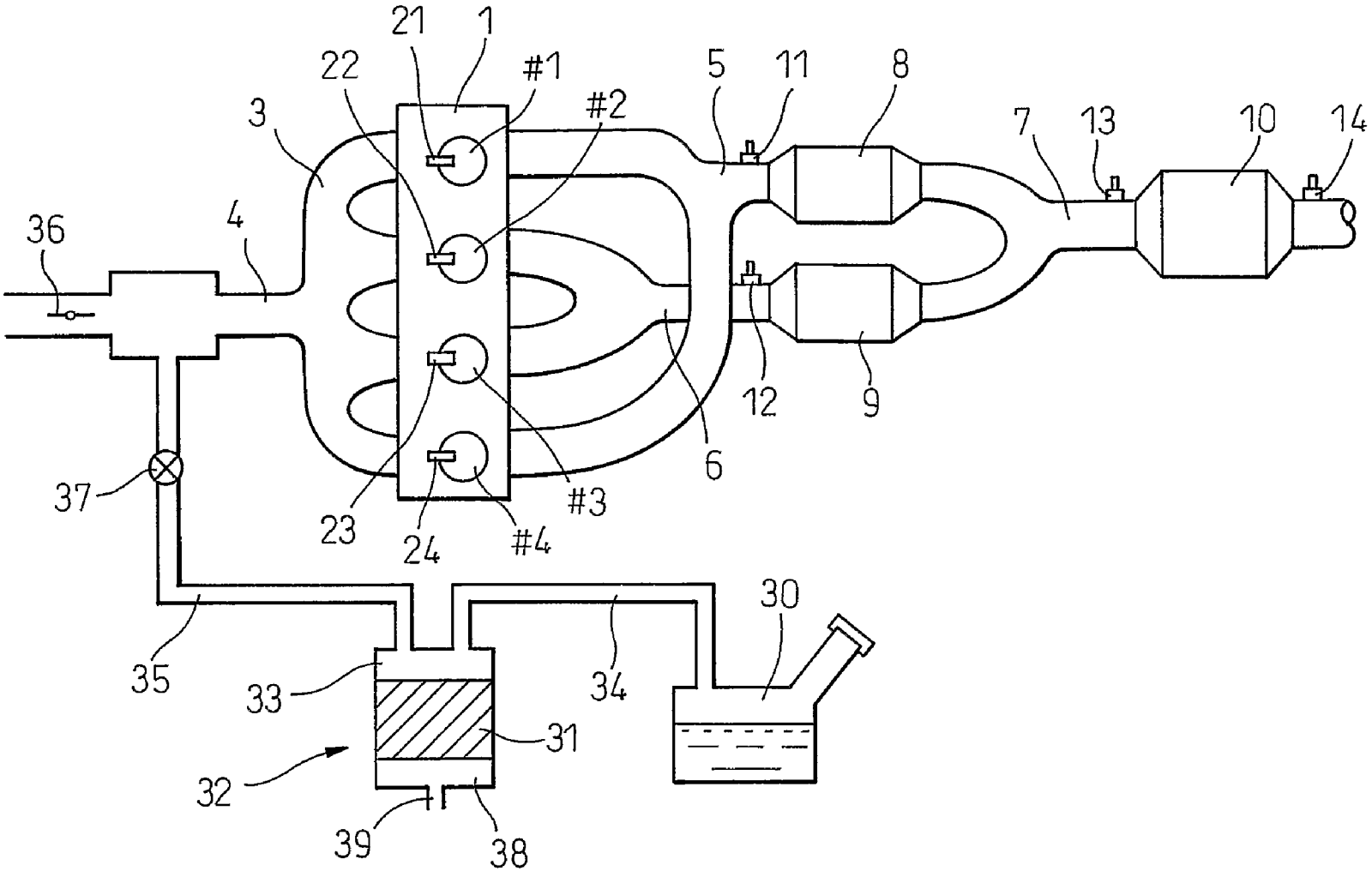
FIG. 1 shows an example of an engine provided with an exhaust gas purification device according to the invention.

With reference to the drawings, the embodiment according to the invention will be explained. FIG. 1 shows an engine provided with an exhaust gas purification device according to the invention. In FIG. 1, 1 denotes the body of the engine, and #1-#4 a first cylinder, a second cylinder, a third cylinder and a fourth cylinder, respectively. Fuel injectors 21, 22, 23 and 24 are provided in the cylinders #1-#4, respectively. An intake pipe 4 is connected to the cylinders via intake branch pipes 3. A first exhaust branch pipe 5 is connected to the first and fourth cylinders #1 and #4, and a second exhaust branch pipe 6 is connected to the second and third cylinders #2 and #3. When the combination of the first and fourth cylinders is referred to as a first cylinder group and the combination of the second and third cylinders is referred to as a second cylinder group, the first exhaust branch pipe 5 is connected to the first cylinder group and the second exhaust branch pipe 6 is connected to the second cylinder group. The exhaust branch pipes 5 and 6 are connected to each other and to a common exhaust pipe 7.

The first exhaust branch pipe 5 is a single pipe at its downstream portion, but branches into two sub-exhaust branch pipes at its upstream portion. Further, the sub-exhaust branch pipes are connected to the first and fourth cylinders, respectively. Similarly, the second exhaust branch pipe 6 is a single pipe at its downstream portion, but branches into two sub-exhaust branch pipes at its upstream portion. Further, the sub-exhaust branch pipes are connected to the second and third cylinders, respectively. Below, the sub-exhaust branch pipes of the exhaust branch pipe are referred to as—branch portions of the exhaust branch pipe—and the downstream single portion of the exhaust branch pipe is referred to as—collective portion of the exhaust branch pipe—.

Three-way catalysts 8 and 9 are positioned in the collective portions of the exhaust branch pipes 5 and 6, respectively. A NOx catalyst 10 is positioned in the exhaust pipe 7. Air-fuel ratio sensors 11 and 12 are positioned in the collective portions of the exhaust pipes 5 and 6 upstream of the three-way catalyst 8 and 9, respectively. Air-fuel ratio sensors 13 and 14 are positioned in the exhaust pipe 7 upstream and downstream of the NOx catalyst 10, respectively.

Figure 2:
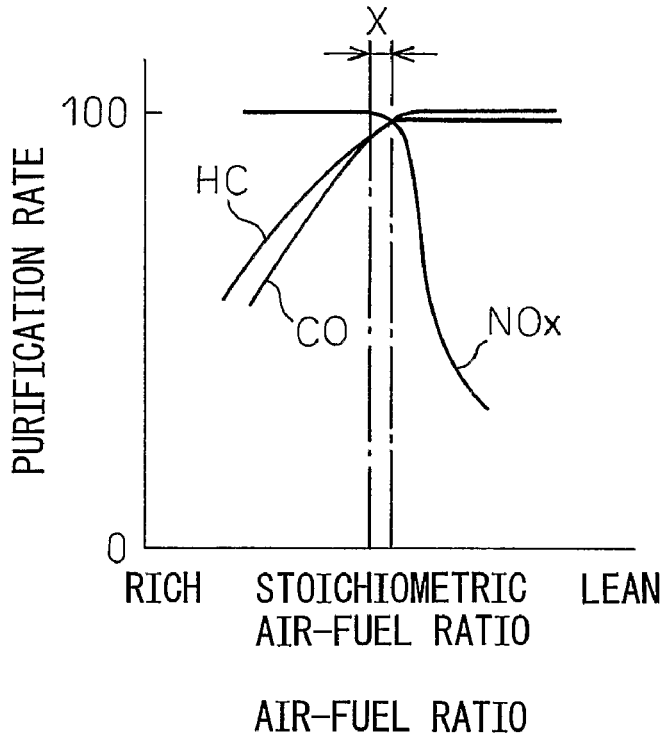
FIG. 2 shows purification characteristics of a three-way catalyst.

As shown in FIG. 2, the three-way catalysts 8 and 9 can purify nitrogen oxide (NOx), carbon monoxide (CO) and hydrocarbon (HC) included in the exhaust gas at high purification rate when the temperature of the catalysts 8 and 9 is greater than a certain temperature (i.e. an activation temperature) and the air-fuel ratio of the exhaust gas flowing into the catalysts 8 and 9 is a substantially stoichiometric air-fuel ratio (i.e. within the zone X in FIG. 2). On the other hand, the three-way catalysts have an oxygen absorbing/releasing ability which absorbs oxygen included in the exhaust gas when the air-fuel ratio of the exhaust gas flowing into the three-way catalyst is larger (leaner) than the stoichiometric air-fuel ratio and releases the absorbed oxygen when the air-fuel ratio of the exhaust gas flowing into the three-way catalyst is smaller (richer) than the stoichiometric air-fuel ratio. When the oxygen absorbing/releasing ability works normally, the air-fuel ratio in the three-way catalysts is maintained substantially at the stoichiometric air-fuel ratio and the NOx, CO and HC are purified at a high purification rate even if the air-fuel ratio of the exhaust gas flowing into the three-way catalysts is larger or smaller than the stoichiometric air-fuel ratio.

The NOx catalyst 10 carries NOx included in the exhaust gas by absorbing or storing the NOx therein when the temperature of the NOx catalyst 10 is greater than a certain temperature (i.e. an activation temperature) and the air-fuel ratio of the exhaust gas flowing into the NOx catalyst 10 is larger (leaner) than the stoichiometric air-fuel ratio. On the other hand, the NOx catalyst 10 purifies the carried NOx by reducing the NOx when the temperature of the NOx catalyst 10 is greater than the certain temperature (i.e. an activation temperature) and the air-fuel ratio of the exhaust gas flowing into the NOx catalyst 10 is smaller (richer) than the stoichiometric air-fuel ratio.

In the condition in which the NOx is carried in the NOx catalyst 10, if the exhaust gas includes sulfur oxide (SOx), the SOx is also carried in the NOx catalyst 10. As already explained, when SOx is carried in the NOx catalyst 10, the amount of NOx which the NOx catalyst can carry therein is decreased. Therefore, in order to maintain the high NOx carrying ability of the NOx catalyst as possible, SOx should be removed from the NOx catalyst. In this connection, SOx can be removed from the NOx catalyst by supplying the exhaust gas having a stoichiometric or rich air-fuel ratio (preferably, rich air-fuel ratio close to the stoichiometric air-fuel ratio) to the NOx catalyst under the condition in which the temperature of the NOx catalyst is maintained at a temperature at which SOx can be removed. In other words, the NOx catalyst of this embodiment releases the SOx therefrom when the temperature of the NOx catalyst is maintained at a certain temperature and the exhaust gas having a stoichiometric or rich air-fuel ratio is supplied to the NOx catalyst.

According to this embodiment, when it is necessary to remove the SOx from the NOx catalyst 10, a sulfate contamination regeneration process (hereinafter referred to as—SPR process—) for maintaining the temperature of the NOx catalyst at a temperature at which SOx can be removed and supplying the exhaust gas having a stoichiometric or rich air-fuel ratio to the NOx catalyst, is performed. That is, according to the SPR process of this embodiment, the air-fuel ratio of the mixture gas in the cylinders is controlled to discharge the exhaust gas having a rich air-fuel ratio (hereinafter referred to as—rich exhaust gas—) from the first and fourth cylinders (i.e. the first cylinder group) and to discharge the exhaust gas having a lean air-fuel ratio (hereinafter referred to as—lean exhaust gas—) from the second and third cylinders (i.e. the second cylinder group).

In the SPR process, a rich degree of the rich exhaust gas and a lean degree of the lean exhaust gas are controlled such that the air-fuel ratio of the exhaust gas resulting from the combination of the rich exhaust gas and the lean exhaust gas and flowing into the NOx catalyst 10 is the stoichiometric or predetermined rich air-fuel ratio.

Generally, the temperature at which the SOx can be removed from the NOx catalyst 10 (hereinafter referred to as—SOx removable temperature—) is greater than the temperature at which the NOx catalyst can carry or purify NOx.

Therefore, in order to remove SOx from the NOx catalyst, it is required to increase the temperature of the NOx catalyst. In this regard, according to the SPR process of this embodiment, reaction heat is generated as a result of the mixture of the rich exhaust gas and the lean exhaust gas and then the reaction of HC included in the rich exhaust gas and oxygen included in the lean exhaust gas. The reaction heat increases the temperature of the NOx catalyst to the SOx removable temperature.

As already explained, in order to remove SOx from the NOx catalyst 10, it is necessary to supply exhaust gas having a stoichiometric or rich air-fuel ratio to the NOx catalyst. In this regard, according to the SPR process of this embodiment, the exhaust gas flowing into the NOx catalyst is at the stoichiometric or rich air-fuel ratio. Therefore, according to the SPR process, SOx can be removed from the NOx catalyst.

It should be noted that it is preferred that the air-fuel ratio of the rich exhaust gas discharged from the cylinders in the SPR process be a rich air-fuel ratio close to the stoichiometric air-fuel ratio, and thus it is preferred that the air-fuel ratio of the lean exhaust gas discharged from the cylinders in the SPR process be a lean air-fuel ratio close to the stoichiometric air-fuel ratio.

Figure 3:
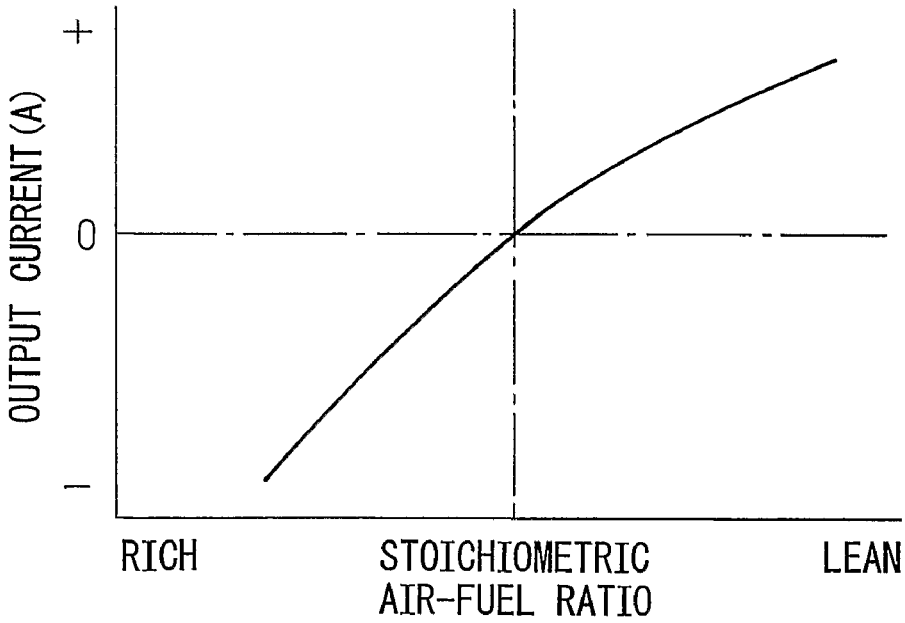
FIG. 3 shows output characteristics of a linear air-fuel ratio sensor.

As the air-fuel ratio sensor, for example, an air-fuel ratio sensor having an output characteristic of the electrical current as shown in FIG. 3, i.e. a so-called linear air-fuel ratio sensor is known. The linear air-fuel ratio sensor outputs 0A when the air-fuel ratio of the exhaust gas is the stoichiometric air-fuel ratio and a current value increased substantially in inverse proportion to the air-fuel ratio of the exhaust gas. That is, the linear air-fuel ratio sensor outputs a current value linearly, depending on the air-fuel ratio of the exhaust gas.

Figure 4:
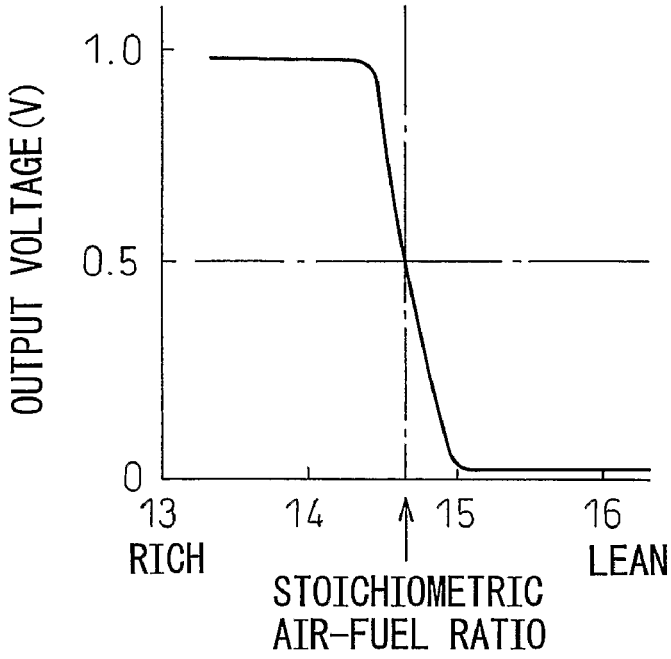
FIG. 4 shows output characteristics of an $O_2$ sensor.

Further, as the air-fuel ratio sensor, for example, an air-fuel ratio sensor, i.e. a so-called $O_2$ sensor having an output characteristic of the voltage as shown in FIG. 4 is known. The $O_2$ sensor outputs a generally 0V when the air-fuel ratio of the exhaust gas is larger than the stoichiometric air-fuel ratio and a generally 1V when the air-fuel ratio of the exhaust gas is smaller than the stoichiometric air-fuel ratio. The output voltage value changes largely across 0.5V at the air-fuel ratio area wherein the air-fuel ratio of the exhaust gas is at about the stoichiometric air-fuel ratio. That is, the $O_2$ sensor outputs different constant voltage values when the air-fuel ratio of the exhaust gas is larger than the stoichiometric air-fuel ratio and when the air-fuel ratio of the exhaust gas is smaller than the stoichiometric air-fuel ratio, respectively.

In the embodiment of the invention, as the air-fuel ratio sensors 11 and 12 positioned upstream of the three-way catalysts 8 and 9 and the air-fuel ratio sensor 13 positioned between the three-way catalysts and the NOx catalyst 10, linear air-fuel ratio sensors are employed. Further, as the air-fuel ratio sensor 14 positioned downstream of the NOx catalyst, an $O_2$ sensor is employed. In this embodiment, the air-fuel ratio of the mixture gas in each cylinder is controlled to a target air-fuel ratio on the basis of the outputs from the sensors. As an example of the air-fuel ratio control according to this embodiment, a normal air-fuel ratio control (hereinafter referred to as—normal A/F control) performed when the engine is normally operated will be explained.

First, a summary of the normal A/F control of this embodiment will be presented. When the air-fuel ratio sensors 11 and 12 positioned upstream of the three-way catalysts 8 and 9 (hereinafter referred to as—linear sensor—, respectively) indicate that the air-fuel ratio of the exhaust gas (hereinafter referred to as—exhaust gas air-fuel ratio—) is larger (leaner) than the stoichiometric air-fuel ratio, the air-fuel ratio of the mixture gas filled in the cylinder (hereinafter referred to as—mixture gas air-fuel ratio—) is also larger (leaner) than the stoichiometric air-fuel ratio and thus, the amount of fuel injected from the fuel injector into the cylinder (hereinafter referred to as—fuel injection amount) is increased such that the mixture gas air-fuel ratio becomes the stoichiometric air-fuel ratio. On the other hand, the linear sensors 11 and 12 indicate that the exhaust gas air-fuel ratio is smaller (richer) than the stoichiometric air-fuel ratio, the fuel injection amount is decreased such that the mixture gas air-fuel ratio becomes the stoichiometric air-fuel ratio.

Basically, by controlling the fuel injection amount as explained above, the mixture gas air-fuel ratio is controlled to the stoichiometric air-fuel ratio. However, when an output error occurs in the linear sensors 11 and 12, the mixture gas air-fuel ratio is not controlled to the stoichiometric air-fuel ratio. For example, if the linear sensor tends to indicate an exhaust gas air-fuel ratio smaller (richer) than the actual exhaust gas air-fuel ratio, even when the actual exhaust gas air-fuel ratio is controlled to the stoichiometric air-fuel ratio, the exhaust gas air-fuel ratio is deemed to be smaller (richer) than the stoichiometric air-fuel ratio. In this case, the fuel injection amount is decreased, and thus the mixture gas air-fuel ratio is controlled to an air-fuel ratio larger (leaner) than the stoichiometric air-fuel ratio. On the other hand, if the linear sensor tends to indicate an exhaust gas air-fuel ratio larger (leaner) than the actual exhaust gas air-fuel ratio, the mixture gas air-fuel ratio is controlled to an air-fuel ratio smaller (richer) than the stoichiometric air-fuel ratio.

In this embodiment, output errors of the linear air-fuel sensors 11 and 12 are compensated for by using an output of the $O_2$ sensor 14 downstream of the NOx catalyst 10. That is, when no output error occurs in the linear sensors and thus, the mixture gas air-fuel ratio is controlled to the stoichiometric air-fuel ratio, the air-fuel ratio of the exhaust gas flowing out of the NOx catalyst is controlled to the stoichiometric air-fuel ratio. In this case, the $O_2$ sensor outputs 0.5V (hereinafter referred to as—reference output voltage value—) corresponding to the stoichiometric air-fuel ratio.

However, when an output error occurs in the linear sensors and thus, for example, the mixture gas air-fuel ratio is controlled to an air-fuel ratio smaller (richer) than the stoichiometric air-fuel ratio, the air-fuel ratio of the exhaust gas flowing out of the NOx catalyst 10 is controlled to an air-fuel ratio smaller (richer) than the stoichiometric air-fuel ratio. In this case, the $O_2$ sensor 14 outputs a voltage value corresponding to the air-fuel ratio smaller (richer) than the stoichiometric air-fuel ratio. In this case, the difference between the output voltage value of the $O_2$ sensor and the reference output voltage value indicates an output error of the linear sensor. Therefore, in this embodiment, on the basis of the difference between the output voltage value of the $O_2$ sensor and the reference output voltage value, the output current value of the linear sensor is corrected so as to compensate for an output error of the linear sensor.

On the other hand, when an output error occurs in the linear sensors, and thus the mixture gas air-fuel ratio is controlled to an air-fuel ratio larger (leaner) than the stoichiometric air-fuel ratio, the output current value of the linear sensor is corrected so as to compensate for an output error of the linear sensor on the basis of the difference between the output voltage value of the $O_2$ sensor 14 and the reference output voltage value.

The normal A/F control of this embodiment will be explained in detail. In this embodiment, a base period of activating the fuel injector to make the mixture gas air-fuel ratio the stoichiometric air-fuel ratio (hereinafter referred to as—a base activating period—) is determined by using the following expression 1.

$$TAUB=\alpha*Ga/Ne \quad (1)$$

In the expression 1, $\alpha$ is a is a constant, Ga is the intake air amount (i.e. the amount of air in the cylinder) and Ne is the engine speed. That is, according to this embodiment, the base activating period is calculated by using the intake air amount per unit engine speed, and thus the base activating period is increased substantially in proportion to the intake air amount per unit engine speed.

Further, the period of activation of the fuel injector TAU is determined by using the following expression 2.

$$TAU=TAUB*F1*\beta*\gamma \quad (2)$$

In the expression 2, F1 is a correction coefficient (hereinafter referred to as a—main correction coefficient—) calculated as explained below, $\beta$ and $\gamma$ are constants determined on the basis of the engine operating condition, respectively.

The main correction coefficient F1 is calculated by using the following expression 3.

$$F1=Kp1*(I-F2-I_0)+Ki1*\int(I-F2-I_0)dt+Kd1d(I-F2-I_0)/dt \quad (3)$$

In the expression 3, $I_0$ is a current value to be output from the linear sensors 11 and 12 when the exhaust gas air-fuel ratio is the stoichiometric air-fuel ratio. I is a current value actually output from the linear sensors 11 and 12. F2 is a correction coefficient (hereinafter, referred to as a—sub-correction coefficient—) calculated as explained below. Kp1 is the proportional gain, Ki1 is the integral gain, and Kd1 is the derivative gain. Therefore, the main correction coefficient F1 is PID-controlled.

On the other hand, the sub-correction coefficient F2 is calculated by using the following expression 4.

$$F2=Kp2*(V_0-V)+Ki2*\int(V_0-V)dt+Kd2*d(V_0-V)/dt \quad (4)$$

In the expression 4, $V_0$ is the voltage value to be output from $O_2$ sensor 14 when the exhaust gas air-fuel ratio is the stoichiometric air-fuel ratio. V is the voltage value actually output from the $O_2$ sensor 14. Kp2 is the proportional gain, Ki2 is the integral gain, and Kd2 is the derivative gain. Therefore, the sub-correction coefficient F2 is also PID-controlled.

As explained above, according to this embodiment, the mixture gas air-fuel ratio is controlled to the stoichiometric air-fuel ratio.

In this embodiment, when the SPR process is performed, the rich or lean degree of the air-fuel ratio of the exhaust gas discharged from each cylinder group is controlled by the rich or lean degree of the mixture gas air-fuel ratio in each cylinder group such that the air-fuel ratio of the exhaust gas flowing into the NOx catalyst 10 becomes a predetermined air-fuel ratio. A control to control the mixture gas air-fuel ratio in each cylinder group such that the air-fuel ratio of the exhaust gas flowing into the NOx catalyst becomes the stoichiometric air-fuel ratio when the SPR process is performed (hereinafter referred to as the—SPR A/F ratio control) will be explained.

First, a summary of the SPR A/F ratio control of this embodiment will be presented. In this embodiment, when the SPR process is performed, in order to make the air-fuel ratio of the exhaust gas flowing into the NOx catalyst 10 the stoichiometric air-fuel ratio, the base fuel injection amount to make the mixture gas air-fuel ratio the stoichiometric air-fuel ratio is increased by a predetermined amount in one of the cylinder groups, while the base fuel injection amount to make the mixture gas air-fuel ratio the stoichiometric air-fuel ratio is decreased by the predetermined amount in the other cylinder group. Thereby, the exhaust gas having a rich air-fuel ratio is discharged from one of the cylinder groups, while the exhaust gas having a lean air-fuel ratio is discharged from the other cylinder group. In this case, in theory, the air-fuel ratio of the exhaust gas flowing into the NOx catalyst is the stoichiometric air-fuel ratio.

However, in actuality, for reasons such as variation of the functions of the fuel injectors, the air-fuel ratio of the exhaust gas flowing into the NOx catalyst is often not the stoichiometric air-fuel ratio. In this case, for example, the air-fuel ratio of the exhaust gas flowing into the NOx catalyst is smaller (richer) than the stoichiometric air-fuel ratio, the linear sensor 13 outputs a current value corresponding to the rich air-fuel ratio. In this embodiment, when the linear sensor 13 outputs a current value corresponding to the rich air-fuel ratio, the fuel injection amount in the cylinders in which the mixture gas having a rich air-fuel ratio burns, is decreased, and/or the fuel injection amount in the cylinders in which the mixture gas having a lean air-fuel ratio burns, is decreased such that the air-fuel ratio of the exhaust gas flowing into the NOx catalyst becomes the stoichiometric air-fuel ratio.

On the other hand, when the linear sensor 13 outputs a current value corresponding to the lean air-fuel ratio, the fuel injection amount in the cylinders in which the mixture gas having a rich air-fuel ratio burns, is increased, and/or the fuel injection amount in the cylinders in which the mixture gas having a lean air-fuel ratio burns, is increased such that the air-fuel ratio of the exhaust gas flowing into the NOx catalyst becomes the stoichiometric air-fuel ratio.

When the fuel injection amount in each cylinder is controlled as explained above, if no output error occurs in the linear sensor 13, the air-fuel ratio of the exhaust gas flowing into the NOx catalyst 10 is controlled to the stoichiometric air-fuel ratio. However, if an output error occurs in the linear sensor 13 and thus, for example, the sensor 13 tends to output a current value corresponding to an air-fuel ratio smaller (richer) than the actual air-fuel ratio, the air-fuel ratio of the exhaust gas flowing into the NOx catalyst is controlled to an air-fuel ratio larger (leaner) than the stoichiometric air-fuel ratio. On the other hand, if the sensor 13 tends to output a current value corresponding to an air-fuel ratio larger (leaner) than the actual air-fuel ratio, the air-fuel ratio of the exhaust gas flowing into the NOx catalyst is controlled to an air-fuel ratio smaller (richer) than the stoichiometric air-fuel ratio.

For example, when the air-fuel ratio of the exhaust gas flowing into the NOx catalyst 10 is smaller (richer) than the stoichiometric air-fuel ratio, the $O_2$ sensor 14 outputs a voltage value larger than the reference output voltage value which is output from the $O_2$ sensor when the exhaust gas air-fuel ratio is the stoichiometric air-fuel ratio. In this case, the difference between the voltage value actually output from the $O_2$ sensor and the reference output voltage value indicates an output error of the linear sensor 13. In this embodiment, on the basis of the difference between the voltage value actually output from the $O_2$ sensor and the reference output voltage value, the current value output from the linear sensor is corrected so as to compensate the output error of the linear sensor.

Similarly, when the air-fuel ratio of the exhaust gas flowing into the NOx catalyst 10 is larger (leaner) than the stoichiometric air-fuel ratio, the current value output from the linear air-fuel sensor is corrected so as to compensate the output error of the linear sensor on the basis of the difference between the voltage value actually output from the $O_2$ sensor 14 and the reference output voltage value.

The SPR A/F ratio control of this embodiment will be explained in detail. In this embodiment, the base activating period, which corresponds to a period of activating the fuel injector to make the mixture air-fuel ratio the stoichiometric air-fuel ratio, is determined by using the following expression 5.

$$TAUB=\alpha*Ga/Ne \quad (5)$$

This expression 5 is the same as the expression 1. $\alpha$ is a constant, Ga is the intake air amount and Ne is the engine speed.

Further, the period of activation of the fuel injector TAUR in the cylinder in which the mixture gas having a rich air-fuel ratio burns is finally determined by using the following expression 6, while the period of activation of the fuel injector TAUL in the cylinder in which the mixture gas having a lean air-fuel ratio burns, is finally determined by using the following expression 7.

$$TAUR=TAUB*R*F3*\beta*\gamma \quad (6)$$

$$TAUL=TAUB*L*F3*\beta*\gamma \quad (7)$$

In the expressions 6 and 7, R is larger than 1 and a constant to increase the base activating period to increase the fuel injection amount, while L is smaller than 1 and a constant to decrease the base activating period to decrease the fuel injection amount. F3 is a correction coefficient (hereinafter referred to as—SPR main correction coefficient) calculated as explained below. $\beta$ and $\gamma$ are constants determined on the basis of the engine operating condition, respectively.

The SPR main correction coefficient F3 is calculated by using the following expression 8.

$$F3=Kp3*(I-F4-I_0)+Ki3*\int(I-F4-I_0)dt+Kd3*d(I-F4-I_0)dt \quad (8)$$

In the expression 8, $I_0$ is the current value to be output from the linear sensor 13 when the exhaust gas air-fuel ratio is the stoichiometric air-fuel ratio. I is a current value actually output from the linear sensor 13. F4 is a correction coefficient (hereinafter referred to as the—SPR sub-correction coefficient—) calculated as explained below. Kp3 is the proportional gain, Ki3 is the integral gain, and Kd3 is the derivative gain. Therefore, the SPR main correction coefficient F3 is PID-controlled.

On the other hand, SPR sub-correction coefficient F4 is calculated by using the following expression 9.

$$F4=Kp4*(V_0-V)+Ki4*\int(V_0-V)dt+Kd4*d(V_0-V)/dt \quad (9)$$

In the expression 9, $V_0$ is the voltage value to be output from the $O_2$ sensor 14 when the exhaust gas air-fuel ratio is the stoichiometric air-fuel ratio. V is the voltage value actually output from the $O_2$ sensor 14. Kp4 is the proportional gain, Ki4 is the integral gain, and Kd4 is the derivative gain. Therefore, the SPR sub-correction coefficient F4 is also PID-controlled.

As explained above, according to this embodiment, when the SPR process is performed, the air-fuel ratio of the exhaust gas flowing into the NOx catalyst 10 is controlled to the stoichiometric air-fuel ratio.

As shown in FIG. 1, the engine of this embodiment has a charcoal canister 32 which contains activated charcoal 31 for carrying fuel vapor generated in the fuel tank 30 by adsorbing it thereon. An interior 33 of the canister 33 on one side of the activated charcoal 31 is in communication with the interior of the fuel tank 30 via a vapor passage 34 and can be in communication with the interior of the intake pipe 4 downstream of the throttle valve 36 via a purge passage 35. A purge control valve 37 for controlling the flow cross area of the purge passage 35 is positioned in the purge passage 35. When the purge control valve 37 opens, the interior 33 of the canister 32 comes into communication with the intake pipe 4 via the purge passage 35. Further, an interior 38 of the canister 32 on the other side of the activated charcoal 31 is in communication with the air via an air pipe 39.

As explained above, the fuel vapor generated in the fuel tank 30 is carried on the activated charcoal 31 of the canister 32. However, the amount of the fuel vapor which can be carried by the activated charcoal 31 is limited. Therefore, before the activated charcoal 31 is saturated by the fuel vapor, the fuel vapor should be removed from the activated charcoal 31. In this embodiment, when the engine is operated and a predetermined condition is satisfied, the purge control valve 37 is opened to discharge the fuel vapor from the activated charcoal 31 to the intake pipe 4 via the purge passage 35.

That is, when the engine is operated, a negative pressure (hereinafter referred to as a—intake negative pressure—) is generated in the intake pipe 4 downstream of the throttle valve 36. Therefore, when the purge control valve 37 is opened, the intake negative pressure is introduced into the canister 32 via the purge passage 35. By this introduced intake negative pressure, the air is introduced into the canister 32 via the air passage 35 and is introduced into the intake pipe 4 via the purge passage 35. By way of the air flowing through the canister 32, the fuel vapor carried on the activated charcoal 31 is introduced into the intake pipe 4. In this embodiment, for example, when the normal A/F control is performed, the purge control valve 37 is opened to introduce the fuel vapor from the canister 32 into the intake pipe 4. The control of the purge control valve 37 when the normal A/F control is performed will be explained in detail.

In this embodiment, a purge ratio for the normal A/F control is predetermined on the basis of the engine operating condition, in particular, the engine speed and the required torque. The purge ratio corresponds to the ratio of the amount of gas including the air and fuel vapor (hereinafter referred to as—purge gas—) introduced into the intake pipe 4 via the purge passage 35 relative to the amount of air (hereinafter, referred to as—fresh air—) introduced into each cylinder from upstream of the throttle valve 36. That is, in this embodiment, when the normal A/F control is performed, the target purge ratio is determined on the basis of the engine speed and the required torque, and the opening degree of the purge control valve 37 is controlled such that the actual purge ratio becomes the target purge ratio. When the amount of the fresh air is constant, the purge ratio increases substantially in proportion to the opening degree of the purge control valve 37.

Figure 5:
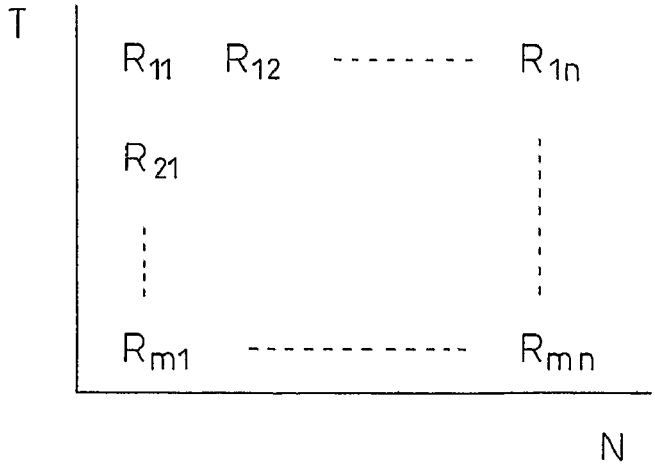
FIG. 5 shows a map of purge ratio R as a function of engine speed N and required torque T.

In this case, for example, as shown in FIG. 5, a map of the target purge ratio as a function of the engine speed N and the required torque T is prepared, and the target purge ratio is determined using the map, or instead of the map, a calculation expression for calculating the target purge ratio on the basis of the above-mentioned parameters is prepared, and the target purge ratio is determined using the calculation expression.

When normal A/F control is performed and the purge gas is introduced into the intake pipe 4, the amount of the fuel introduced into each cylinder is increased by the amount of the fuel vapor included in the purge gas. In this case, the air-fuel ratio of the mixture gas filled in each cylinder deviates from the stoichiometric air-fuel ratio. However, such a deviation is eliminated by the above-explained air-fuel ratio control using the air-fuel ratio sensors 11, 12 and 14.

In this embodiment, when the SPR process is performed, the purge control valve 37 is opened to introduce the fuel vapor from the canister 32 into the intake pipe 4. The control of the purge control valve 37 when the SPR process is performed will be explained.

In the first embodiment of the control of the purge control valve 37 when the SPR process is performed, the concentration of the fuel vapor in the purge gas is detected when the normal A/F control is performed. Then, on the basis of the detected concentration of the fuel vapor in the purge gas, the target purge ratio for the SPR process is determined. In particular, when the detected concentration of the fuel vapor in the purge gas is larger than a predetermined concentration, the purge ratio is decreased. On the other hand, when the detected concentration of the fuel vapor in the purge gas is smaller than the predetermined concentration, the purge ratio is increased. Alternatively, the target purge ratio is decreased substantially in inverse proportion to the detected concentration of the fuel vapor in the purge gas. According to this, the opening degree of the purge control valve 37 is controlled such that the actual purge ratio becomes the target purge ratio.

It is advantageous that the purge ratio for the SPR process is determined on the basis of the concentration of fuel vapor in the purge gas, since it is ensured that the fuel burns in the rich-burn cylinder. That is, when the fuel vapor is introduced into the rich-burn cylinder when the SPR process is performed, the fuel injection amount in the rich-burn cylinder is decreased by the above-explained air-fuel ratio control, and thus it may be ensured that the fuel burns in the rich-burn cylinder. However, the fuel injection amount in the rich-burn cylinder is not always decreased. That is, the fuel injection amount only in the lean-burn cylinder may be decreased. In this case, the amount of fuel in the rich-burn cylinder is large, and thus the fuel may not burn. However, according to this embodiment, when the concentration of fuel vapor in the purge gas is large, i.e. when it is expected that the amount of fuel vapor introduced into the rich-burn cylinder is large, the purge ratio is decreased to decrease the amount of fuel vapor introduced into the rich-burn cylinder. Therefore, it is ensured that the fuel burns in the rich-burn cylinder.

It should be noted that in this embodiment, in addition to the concentration of fuel vapor, the engine operating condition, in particular, the engine speed and the required torque can be used in order to determine the target purge ratio for the SPR process.

In this case, for example, a map of the purge ratio as a function of the concentration of fuel vapor or as a function of the concentration of fuel vapor, the engine speed and the required torque is prepared, and the purge ratio is determined using the map. Otherwise, instead of the map, a calculation expression for calculating the purge ratio on the basis of the above-mentioned parameters is prepared, and the purge ratio is determined using the calculation expression.

Further, the target purge ratio for the SPR process may be determined by correcting the target purge ratio, which is determined for the normal A/F control on the basis of the engine operating condition, on the basis of the concentration of fuel vapor in the purge gas. In this case, in detail, the pre-target purge ratio is determined on the basis of the engine operating condition (in particular, the engine speed and the required torque) in the same manner as that used in the normal A/F control. Then, when the concentration of fuel vapor in the purge gas is smaller than a predetermined concentration, the target purge ratio for the SPR process is set to the pre-target purge ratio. On the other hand, when the concentration of fuel vapor in the purge gas is larger than the predetermined concentration, the target purge ratio for the SPR process is set to a ratio smaller than the pre-target purge ratio, or is set to a ratio decreased from the pre-target purge ratio substantially in inverse proportion to the concentration of fuel vapor in the purge gas.

Further, in the above-explained embodiment, the target purge ratio for the SPR process is changed depending on the concentration of fuel vapor in the purge gas. However, the target amount of purge gas introduced into the intake pipe for the SPR process may be changed depending on the concentration of fuel vapor. In this case, in detail, when the concentration of fuel vapor in the purge gas is larger than a predetermined concentration, the target purge gas amount is set to a small amount. On the other hand, when the concentration of fuel vapor in the purge gas is smaller than the predetermined concentration, the target purge gas amount is set to a large amount. Otherwise, the target purge gas amount is set to an amount changed substantially in inverse proportion to the concentration of fuel vapor in the purge gas. Further, in the case where the target purge gas amount instead of the target purge ratio for the normal A/F control is determined on the basis of the engine operating condition (in particular, the engine speed and the required torque), when the SPR process is performed, the pre-target purge gas amount is determined on the basis of the engine operating condition in the same manner as that used when the normal A/F control is performed. Then, when the concentration of fuel vapor in the purge gas is smaller than a predetermined concentration, the target purge gas for the SPR process is set to the pre-target purge gas amount. On the other hand, when the concentration of fuel vapor in the purge gas is larger than the predetermined concentration, the target purge gas for the SPR process is set to an amount smaller than the pre-target purge gas amount, or is set to an amount decreased from the pre-target purge gas amount substantially in inverse proportion to the concentration of fuel vapor in the purge gas.

It should be noted that when the purge gas is introduced into the intake pipe 4 when the SPR process is performed, the amount of fuel introduced into each cylinder is increased by the amount of fuel vapor included in the purge gas and thus, the air-fuel ratio of the mixture gas filled in each cylinder deviates from the target air-fuel ratio. In this case, however, as explained above, the deviation of the air-fuel ratio from the target air-fuel ratio is compensated by the air-fuel ratio control using the air-fuel ratio sensors 13 and 14.

Figure 6:
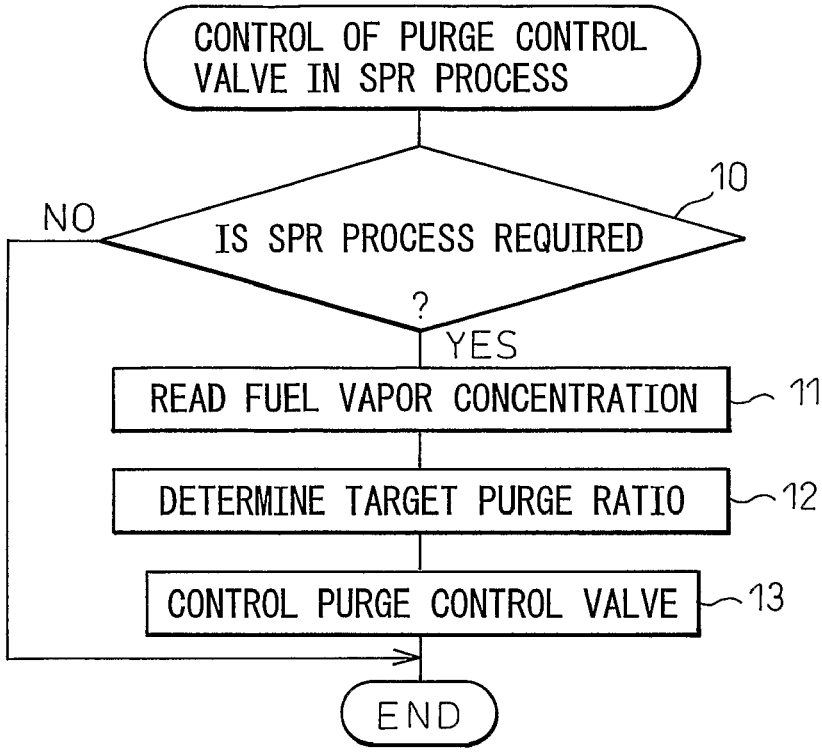
FIG. 6 shows an example of a routine for controlling a purge control valve according to a first embodiment of the invention.

FIG. 6 shows an example of the routine for controlling the purge control valve 37 according to the first embodiment. In the routine shown in FIG. 6, at step 10, it is judged as to whether it is necessary to perform the SPR process. When it is not necessary to perform the SPR process, the routine ends. On the other hand, when it is necessary to perform the SPR process, the routine proceeds to step 11, wherein the concentration of fuel vapor in the purge gas detected in the normal A/F control is read. Next, at step 12, on the basis of the concentration of fuel vapor read at step 11, as explained above in connection with the first embodiment, the target purge ratio is determined. Thereafter, at step 13, the opening degree of the purge control valve 37 is controlled such that the purge ratio becomes the target purge ratio determined at step 12.

The control of the purge control valve 37 in the SPR process according to the second embodiment will be explained. In this embodiment, the target purge ratio is determined on the basis of the rich degree of the mixture gas in the rich-burn cylinder, from which the exhaust gas having the rich air-fuel ratio is discharged when the SPR process is performed. In detail, when the rich degree of the mixture gas in the rich-burn cylinder is larger than a predetermined degree, the target purge ratio is set to a small ratio. On the other hand, when the rich degree of the mixture gas in the rich-burn cylinder is smaller than the predetermined degree, the target purge ratio is set to a large ratio. Otherwise, the target purge ratio is set to a ratio changed substantially in inverse proportion to the rich degree of the mixture gas in the rich-burn cylinder. Then, the opening degree of the purge control valve 37 is controlled such that the purge ratio becomes the target purge ratio.

It is advantageous that the target purge ratio for the SPR process be determined on the basis of the rich degree of the mixture gas in the rich-burn cylinder when the SPR process is performed, since it is ensured that the fuel burns in the rich-burn cylinder. That is, when the rich degree of the mixture gas in the rich-burn cylinder is large and the fuel vapor is introduced into the rich-burn cylinder by introducing the purge gas thereinto, the fuel amount in the rich-burn cylinder becomes large and thus, the fuel may not burn. In this case, according to this embodiment, the target purge ratio is decreased to decrease the amount of fuel vapor introduced into the rich-burn cylinder. Therefore, it is ensured that the fuel burns in the rich-burn cylinder.

Alternatively, in this embodiment, in addition to the rich degree of the mixture gas in the rich-burn cylinder, the engine operating condition (in particular, the engine speed and the required torque) can be used to determine the target purge ratio for the SPR process.

In this case, for example, a map of the target purge ratio as a function of the rich degree of the mixture gas in the rich-burn cylinder or as a function of the rich degree of the mixture gas in the rich-burn cylinder, the engine speed and the required torque is prepared, and the target purge ratio is determined using the map, or instead of the map, a calculation expression for calculating the target purge ratio on the basis of the above-mentioned parameters is prepared, and the target purge ratio is determined using the calculation expression.

Further, the target purge ratio for the SPR process may be determined on the basis of the rich degree of the mixture gas in the rich-burn cylinder and the concentration of fuel vapor in the purge gas. In this case, in detail, when the concentration of fuel vapor in the purge gas is larger than a predetermined concentration, the target purge ratio for the SPR process determined on the basis of the rich degree of the mixture gas in the rich-cylinder as explained above is decreased. On the other hand, when the concentration of fuel vapor in the purge gas is smaller than the predetermined concentration, the target purge ratio for the SPR process determined on the basis of the rich degree of the mixture gas in the rich-burn cylinder as explained above is increased. Otherwise, the target purge ratio for the SPR process determined on the basis of the rich degree of the mixture gas in the rich-burn cylinder as explained above is set to a ratio changed substantially in inverse proportion to the concentration of fuel vapor in the purge gas.

Also, in this case, in addition to the rich degree of the mixture gas in the rich-burn cylinder and the concentration of fuel vapor in the purge gas, the engine operating condition (in particular, the engine speed and the required torque) can be used to determine the target purge ratio for the SPR process.

Further, for example, a map of the target purge ratio as a function of the rich degree of the mixture gas in the rich-burn cylinder and the concentration of fuel vapor in the purge gas or as a function of the rich degree of the mixture gas in the rich-burn cylinder, the concentration of fuel vapor in the purge gas, the engine speed and the required torque is prepared, and the target purge ratio is determined using the map, or instead of the map, a calculation expression for calculating the target purge ratio on the basis of the above-mentioned parameters is prepared, and the target purge ratio is determined using the calculation expression.

Further, the target purge ratio for the SPR process may be determined by correcting the target purge ratio, which is determined for the normal A/F control on the basis of the engine operating condition, on the basis of the rich degree of the mixture gas in the rich-burn cylinder. In this case, in detail, the pre-target purge ratio is determined on the basis of the engine operating condition (in particular, the engine speed and the required torque) in the same manner as that used when the normal A/F control is performed. Then, when the rich degree of the mixture gas in the rich-burn cylinder is smaller than a predetermined degree, the target purge ratio for the SPR process is set to the pre-target purge ratio. On the other hand, when the rich degree of the mixture gas in the rich-burn cylinder is larger than the predetermined degree, the target purge ratio for the SPR process is set to a ratio smaller than the pre-target purge ratio, or is set to a ratio decreased from the pre-target purge ratio substantially in inverse proportion to the rich degree of the mixture gas in the rich-cylinder.

Further, the target purge ratio for the SPR process may be determined by correcting the target purge ratio, which is determined for the normal A/F control on the basis of the engine operating condition, on the basis of the rich degree of the mixture gas in the rich-burn cylinder and the concentration of fuel vapor in the purge gas. In this case, in detail, the pre-target purge ratio is determined on the basis of the rich degree of the mixture gas in the rich-burn cylinder as explained above. Then, when the concentration of fuel vapor is smaller than a predetermined concentration, the target purge ratio for the SPR process is set to the pre-target purge ratio. On the other hand, when the concentration of fuel vapor is larger than the predetermined concentration, the target purge ratio for the SPR process is set to a ratio smaller than the pre-target purge ratio, or is set to a ratio decreased from the pre-target purge ratio substantially in inverse proportion to the concentration of fuel vapor.

Further, in the above-explained embodiment, the target purge ratio for the SPR process is changed depending on the rich degree of the mixture gas in the rich-burn cylinder. However, the target amount of purge gas introduced into the intake pipe for the SPR process may be changed depending on the rich degree of the mixture gas in the rich-burn cylinder. In this case, in detail, when the rich degree of the mixture gas in the rich-burn cylinder is larger than a predetermined degree, the target purge gas amount is set to a small amount. On the other hand, when the rich degree of the mixture gas in the rich-burn cylinder is smaller than the predetermined degree, the target purge gas amount is set to a large amount. Otherwise, the target purge gas amount is set to an amount changed substantially in inverse proportion to the rich degree of the mixture gas in the rich-burn cylinder.

In this case, the target purge gas amount for the SPR process may be determined on the basis of the rich degree of the mixture gas in the rich-burn cylinder and the concentration of fuel vapor in the purge gas. In this case, in detail, the pre-target purge gas amount for the SPR process is determined on the basis of the rich degree of the mixture gas in the rich-burn cylinder as explained above. Then, when the concentration of fuel vapor in the purge gas is larger than a predetermined concentration, the target purge gas amount for the SPR process is set to an amount smaller than the pre-target purge gas amount. On the other hand, when the concentration of fuel vapor in the purge gas is smaller than the predetermined concentration, the target purge gas amount for the SPR process is set to an amount larger than the pre-target purge gas amount. Otherwise, the target purge gas amount for the SPR process is set to an amount changed from the pre-target purge gas amount substantially in inverse proportion to the concentration of fuel vapor in the purge gas. Alternatively, in the case where the target purge gas amount for the normal A/F control is determined on the basis of the engine operating condition (in particular, the engine speed and the required torque), when the concentration of fuel vapor in the purge gas is smaller than a predetermined concentration, the target purge gas amount for the SPR process is set to an amount determined on the basis of the engine operating condition in the same manner as that used in the normal A/F control. On the other hand, when the concentration of fuel vapor in the purge gas is larger than the predetermined concentration, the target purge gas amount for the SPR process is set to an amount smaller than the amount determined in the same manner as that used in the normal A/F control, or is set to an amount decreased from the amount determined in the same manner as that used in the normal A/F control substantially in inverse proportion to the concentration of fuel vapor in the purge gas.

Figure 7:
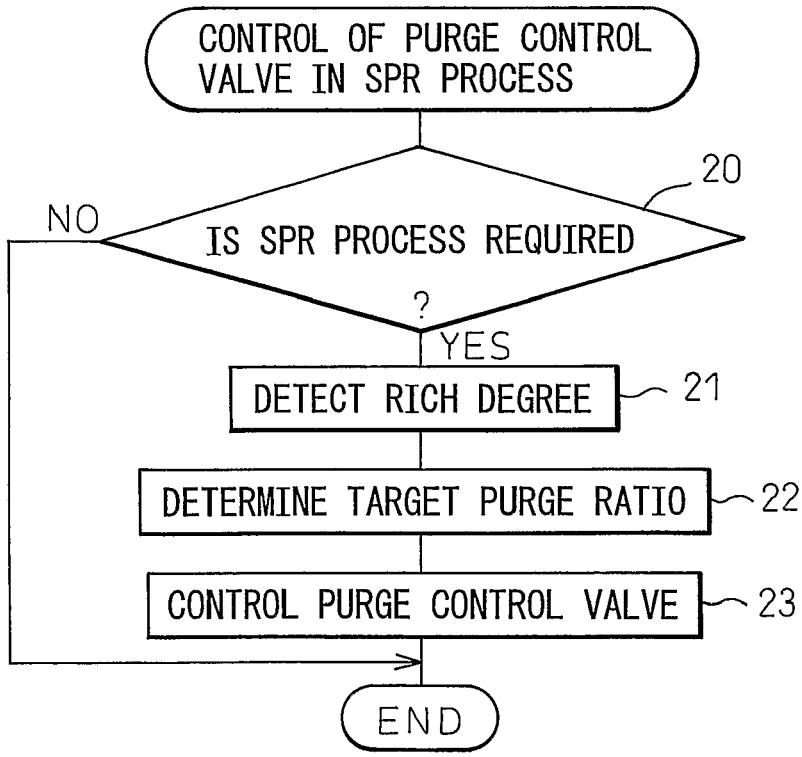
FIG. 7 shows an example of a routine for controlling the purge control valve according to a second embodiment of the invention.

FIG. 7 shows an example of the routine for controlling the purge control valve 37 according to the second embodiment. In the routine shown in FIG. 7, at step 20, it is judged if it is required that the SPR process is performed. When it is not required that the SPR process is performed, the routine ends. On the other hand, when it is required that the SPR process is performed, the routine proceeds to step 21 wherein the rich degree of the mixture gas in the rich-burn cylinder is detected. Next, at step 22, on the basis of the rich degree detected at step 21, as explained above in connection with the second embodiment, the target purge ratio is determined. Next, at step 23, the opening degree of the purge control valve 37 is controlled such that the purge ratio becomes the target purge ratio determined at step 22.

The control of the purge control valve 37 in the SPR process according to the third embodiment will be explained. In this embodiment, the target purge ratio for the SPR process is set to a ratio determined in the same manner as that used in the normal A/F control on the basis of the engine operating condition. Then, the opening degree of the purge control valve 37 is controlled such that the actual purge ratio becomes the target purge ratio. In addition, in this embodiment, when the SPR process is performed, the fuel injection amount in each cylinder is corrected on the basis of the concentration of fuel vapor detected when the normal A/F control is performed. In detail, the amount of fuel vapor (i.e. fuel) introduced into each cylinder by the purge gas is estimated on the basis of the concentration of fuel vapor in the purge gas, and then, for example, the fuel injection amount in the rich-burn cylinder is decreased by the amount of fuel vapor introduced into the rich-burn cylinder, while the fuel injection amount in the lean-burn cylinder, from which the exhaust gas having the lean air-fuel ratio is discharged, is also decreased such that the air-fuel ratio of the exhaust gas flowing into the NOx catalyst 10 becomes a target air-fuel ratio (in particular, the stoichiometric air-fuel ratio).

Alternatively, the fuel injection amount in the rich-burn cylinder and the lean-burn cylinder may be decreased by the amount of fuel vapor introduced into each cylinder.

It is advantageous that the fuel injection amount in the rich-burn cylinder is corrected on the basis of the concentration of fuel vapor in the purge gas as explained above when the SPR process, since it is ensured that the fuel burns in the rich-burn cylinder. That is, according to this embodiment, when the concentration of fuel vapor in the purge gas is large, i.e. when it is expected that the amount of fuel vapor introduced into the rich-burn cylinder is large, the purge ratio is decreased to decrease the amount of fuel vapor introduced into the rich-burn cylinder. Therefore, it is ensured that the fuel burns in the rich-burn cylinder.

Figure 8:
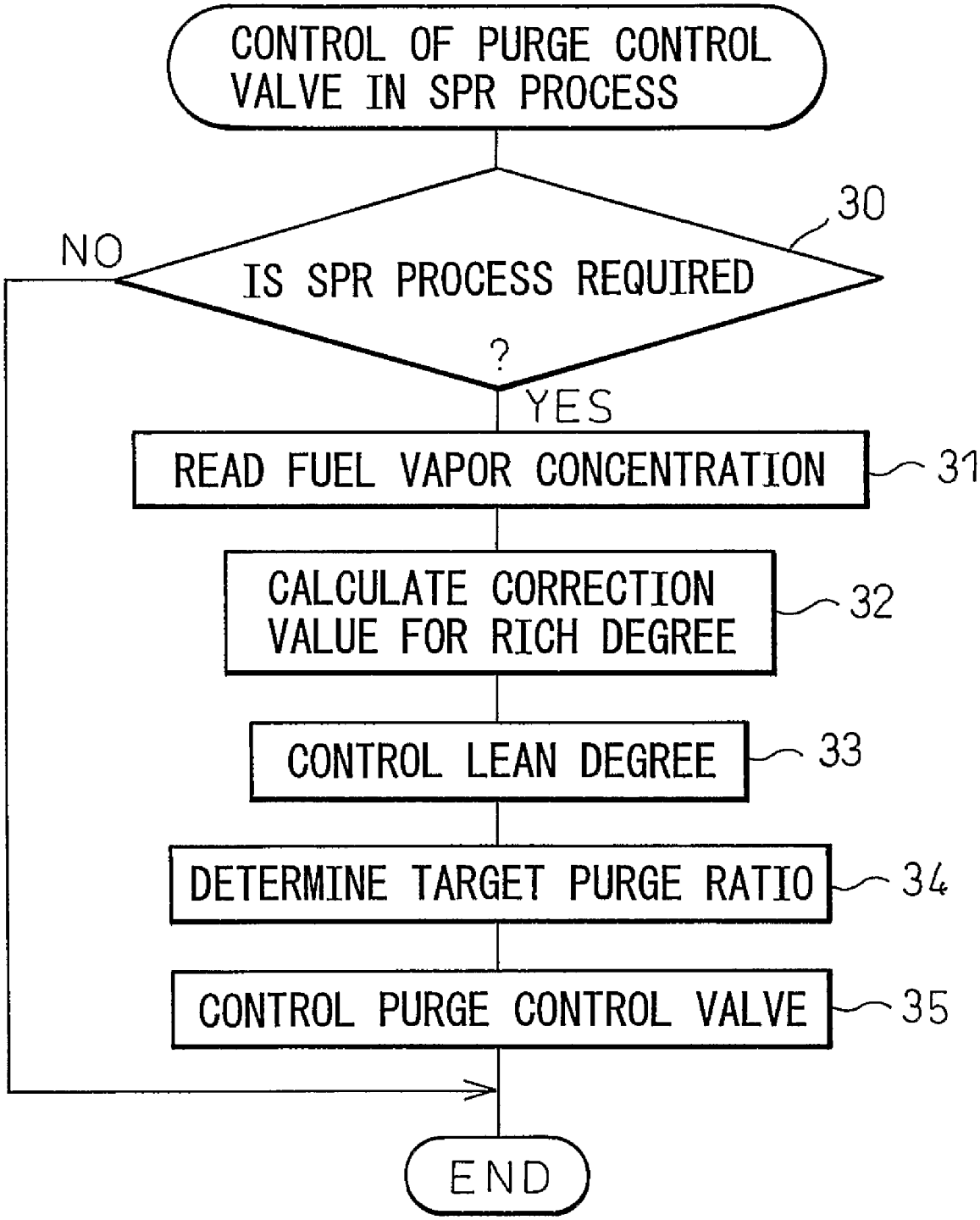
FIG. 8 shows an example of a routine for controlling the purge control valve according to a third embodiment of the invention.

FIG. 8 shows an example of the routine for controlling the purge control valve 37 according to the third embodiment. In the routine shown in FIG. 8, at step 30, it is judged if it is required that the SPR process is performed. When it is not required that the SPR process is performed, the routine ends. On the other hand, when it is necessary for the SPR process to be performed, the routine proceeds to step 31, wherein the concentration of fuel vapor in the purge gas detected when the normal A/F control is performed is read. Next, at step 32, on the basis of the concentration of fuel vapor read at step 21, as explained above in connection with the third embodiment, the rich degree of the mixture gas in the rich-burn cylinder is calculated. Next, at step 33, as explained above in connection with the third embodiment, the lean degree of the mixture gas in the lean-burn cylinder is controlled. Next, at step 34, as explained above in connection with the third embodiment, the target purge ratio is determined. Thereafter, at step 35, the opening degree of the purge control valve 37 is controlled such that the actual purge ratio becomes the target purge ratio determined at step 34.

The control of the purge control valve 37 in the SPR process according to the fourth embodiment will be explained. In this embodiment, when it is necessary to perform the SPR process and the concentration of fuel vapor in the purge gas detected in the normal A/F control is larger than a predetermined concentration, the SPR process is not performed, and, for example, the normal A/F control is continuously performed. On the other hand, when the concentration of fuel vapor is smaller than the predetermined concentration, the SPR process is performed.

In this embodiment, when the SPR process is prohibited from being performed, the opening degree of the purge control valve 37 may be increased from the normally set degree to make the concentration of fuel vapor in the purge gas smaller than the predetermined concentration early. As a result, the SPR process is performed early.

Further, when the SPR process is allowed to be performed, and thereafter the SPR process begins, the purge control valve 37 is controlled according to any of the above-explained embodiment.

It is preferable that the SPR process be prohibited from being performed when the concentration of fuel vapor in the purge gas is larger than the predetermined concentration, since it is thereby ensured that the fuel burns in the rich-burn cylinder. That is, according to this embodiment, when the amount of fuel vapor introduced into the rich-burn cylinder is large, i.e. when it is expected that the amount of fuel in the rich-burn cylinder is large, the SPR process itself is proinhibited. Therefore, the fuel assuredly burns in the rich-burn cylinder.

Figure 9:
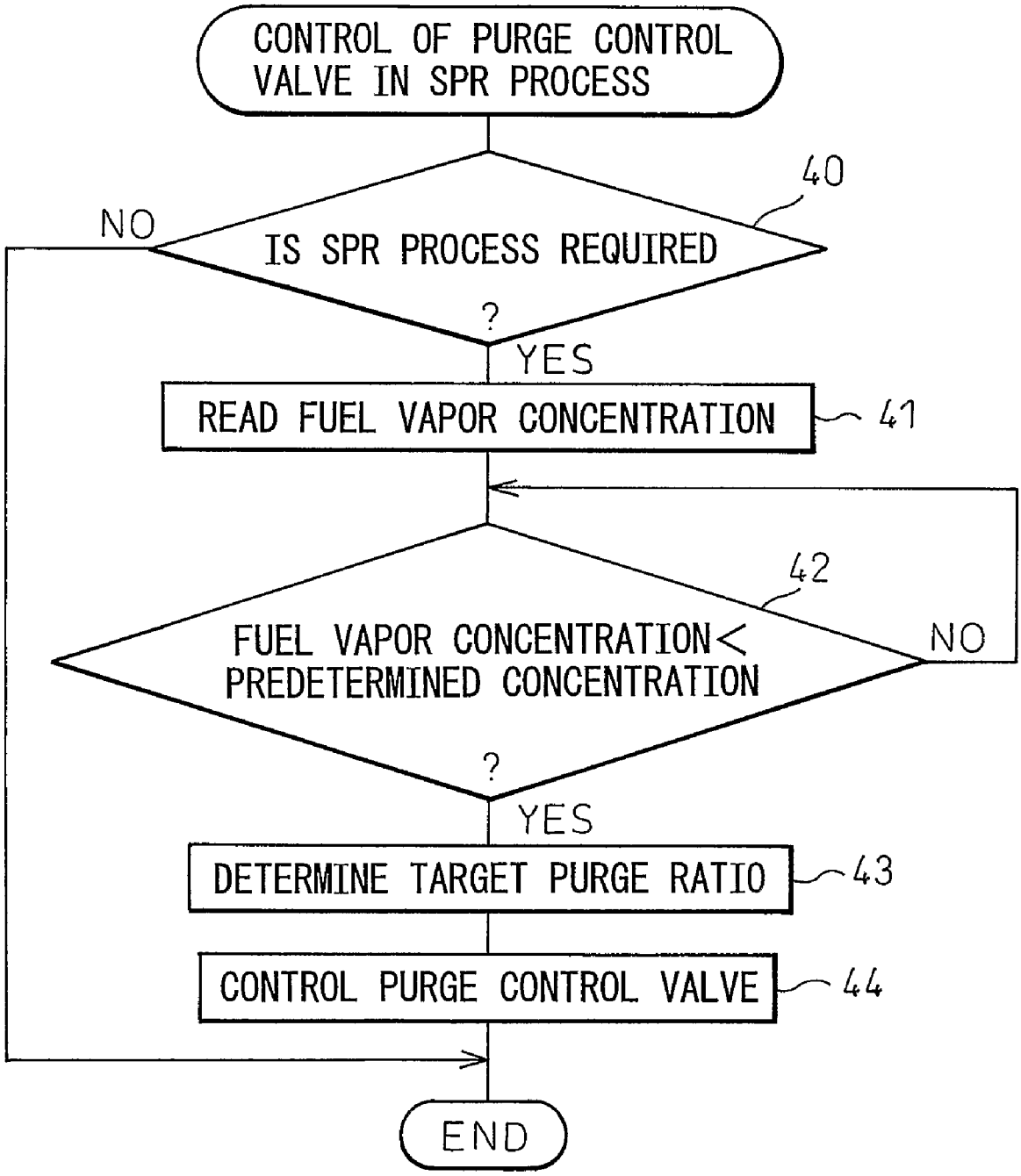
FIG. 9 shows an example of a routine for controlling the purge control valve according to a fourth embodiment of the invention.

FIG. 9 shows an example of the routine for controlling the purge control valve 37 according to the fourth embodiment. In the routine shown in FIG. 9, at step 40, it is judged as to whether it is necessary for the SPR process to be performed. When it is not necessary to perform the SPR process, the routine ends. On the other hand, when it is necessary to perform the SPR process, the routine proceeds to step 41 wherein the concentration of fuel vapor in the purge gas detected in the normal A/F control is read. Next, step 42, it is judged if the concentration of fuel vapor read at step 41 is smaller than a predetermined concentration. When the concentration of fuel vapor is larger than the predetermined concentration, step 42 is repeated. As a result, the SPR process is not performed. On the other hand, when the concentration of fuel vapor is smaller than the predetermined concentration, the routine proceeds to step 43 wherein the target purge ratio is set as explained above in connection with the fourth embodiment. Next, at step 44, the opening degree of the purge control valve 37 is controlled such that the actual purge ratio becomes the target purge ratio set at step 43.

It should be noted that the invention can be applied to an engine having three or more cylinder groups.

While the invention has been described by reference to specific embodiments chosen for purposes of illustration, it should be apparent that numerous modifications can be made thereto, by those skilled in the art, without departing from the basic concept and scope of the invention.

The invention claimed is:

1. An exhaust gas purification device for an engine, comprising:

a plurality of cylinders, the cylinders being divided into at least two cylinder groups;

exhaust branch pipes connected to the cylinder groups at their upstream ends, respectively;

a common exhaust pipe connected to downstream ends of the exhaust branch pipes;

a NOx catalyst positioned in the common exhaust pipe;

a controller configured to control an amount of purge gas such that if a sulfate contamination regeneration process for regenerating a sulfate contamination of the NOx catalyst is performed by controlling an air-fuel ratio of exhaust gas discharged from one of the cylinder groups to a rich air-fuel ratio and controlling an air-fuel ratio of exhaust gas discharged from an other cylinder group to a lean air-fuel ratio and a purge gas including fuel vapor is purged into an intake pipe, then an amount of purge gas is controlled to a target quantity for the sulfate contamination regeneration process on the basis of a concentration of fuel vapor in the purge gas determined by at least one sensor located downstream of the plurality of cylinders;

exhaust branch pipe sensors provided to the exhaust branch pipes, respectively, that detect an air-fuel ratio of the exhaust branch pipes;

a first NOx catalyst sensor provided in the common exhaust pipe upstream of the NOx catalyst, that detects an air-fuel ratio of the common exhaust pipe upstream of the NOx catalyst; and a second NOx catalyst sensor provided in the common exhaust pipe downstream of the NOx catalyst, that detects an air-fuel ratio of the common exhaust pipe downstream of the NOx catalyst, wherein the concentration of the fuel vapor of the purge gas is determined based on the first and second NOx catalyst sensors.

2. A device as set forth in claim 1, wherein when the sulfate contamination regeneration process is performed, the purge gas including fuel vapor is purged into the intake pipe and the concentration of fuel vapor in the purge gas is larger than a predetermined concentration, the amount of purge gas is decreased.

3. A device as set forth in claim 1, wherein when the sulfate contamination regeneration process is performed and the purge gas including fuel vapor is purged into the intake pipe, the amount of purge gas is decreased substantially in inverse proportion to the concentration of fuel vapor in the purge gas.

4. An exhaust gas purification device for an engine, comprising:

a plurality of cylinders, the cylinders being divided into at least two cylinder groups;

exhaust branch pipes connected to the cylinder groups at their upstream ends, respectively;

a common exhaust pipe connected to downstream ends of the exhaust branch pipes;

a NOx catalyst positioned in the common exhaust pipe;

a controller configured to control an amount of purge gas such that if a sulfate contamination regeneration process for regenerating a sulfate contamination of the NOx catalyst is performed by controlling an air-fuel ratio of exhaust gas discharged from one of the cylinder groups to a rich air-fuel ratio and controlling an air-fuel ratio of exhaust gas discharged from an other cylinder group to a lean air-fuel ratio, a purge gas including fuel vapor is purged into an intake pipe, and a rich degree of a mixture gas in the one cylinder group from which the exhaust gas having the rich air-fuel ratio is discharged is larger than a predetermined degree, then the amount of purge gas is decreased;

exhaust branch pipe sensors provided to the exhaust branch pipes, respectively, that detect an air-fuel ratio of the exhaust branch pipes;

a first NOx catalyst sensor provided in the common exhaust pipe upstream of the NOx catalyst, that detects an air-fuel ratio of the common exhaust pipe upstream of the NOx catalyst; and a second NOx catalyst sensor provided in the common exhaust pipe downstream of the NOx catalyst, that detects an air-fuel ratio of the common exhaust pipe downstream of the NOx catalyst, wherein the rich degree of the mixture gas in the one cylinder group from which the exhaust gas having the rich air-fuel ratio is discharged is determined to be larger than the predetermined degree based on the exhaust branch pipe sensor provided to the exhaust branch pipe downstream of the one cylinder group which has the rich air-fuel ratio and the first NOx sensor.

5. A device as set forth in claim 4, wherein when the sulfate contamination regeneration process is performed, the purge gas including fuel vapor is purged into the intake pipe and the concentration of fuel vapor in the purge gas is larger than a predetermined concentration, the amount of purge gas is decreased.

6. An exhaust gas purification device for an engine, comprising:

a plurality of cylinders, the cylinders being divided into at least two cylinder groups;

exhaust branch pipes connected to the cylinder groups at their upstream ends, respectively;

a common exhaust pipe connected to downstream ends of the exhaust branch pipes;

a NOx catalyst positioned in the common exhaust pipe; and a controller configured to control an amount of purge gas such that if a sulfate contamination regeneration process for regenerating a sulfate contamination of the NOx catalyst is performed by controlling an air-fuel ratio of exhaust gas discharged from one of the cylinder groups to a rich air-fuel ratio and controlling an air-fuel ratio of exhaust gas discharged from an other cylinder group to a lean air-fuel ratio and a purge gas including fuel vapor is purged into an intake pipe, then an air-fuel ratio of a mixture gas in each cylinder is controlled on the basis of a concentration of fuel vapor in the purge gas determined by at least one sensor located downstream of the plurality of cylinders;

exhaust branch pipe sensors provided to the exhaust branch pipes, respectively, that detect an air-fuel ratio of the exhaust branch pipes;

a first NOx catalyst sensor provided in the common exhaust pipe upstream of the NOx catalyst, that detects an air-fuel ratio of the common exhaust pipe upstream of the NOx catalyst; and a second NOx catalyst sensor provided in the common exhaust pipe downstream of the NOx catalyst, that detects an air-fuel ratio of the common exhaust pipe downstream of the NOx catalyst, wherein the concentration of the fuel vapor of the purge gas is determined based on the first and second NOx catalyst sensors.

7. A device as set forth in claim 6, wherein when the sulfate contamination regeneration process is performed, the purge gas including fuel vapor is purged into the intake pipe and the concentration of fuel vapor in the purge gas is larger than a predetermined concentration, a rich degree of the mixture gas in the cylinder from which the exhaust gas having the rich air-fuel ratio is discharged, is decreased, while a lean degree of the mixture gas in the cylinder from which the exhaust gas having the lean air-fuel ratio is discharged, is increased.

8. A device as set forth in claim 6, wherein when the sulfate contamination regeneration process is performed and the purge gas including fuel vapor is purged into the intake pipe, the rich degree of the mixture gas in the cylinder from which the exhaust gas having the rich air-fuel ratio is discharged, is decreased substantially in inverse proportion to the concentration of fuel vapor in the purge gas, while the lean degree of the mixture gas in the cylinder from which the exhaust gas having the lean air-fuel ratio is discharged, is increased substantially in proportion to the concentration of fuel vapor in the purge gas.

* * * * *